United States Patent [19]

Knowles

[11] 4,009,927

[45] Mar. 1, 1977

[54] SPIRAL CRIMP FOR RETAINING A WIRE CONDUCTOR IN A METAL CONTACT

[75] Inventor: Robert Gordon Knowles, Litchfield, Conn.

[73] Assignee: Litton Systems, Inc., Beverly Hills, Calif.

[22] Filed: Oct. 21, 1975

[21] Appl. No.: 624,436

Related U.S. Application Data

[63] Continuation-in-part of Ser. No. 493,862, Aug. 2, 1974, abandoned.

[52] U.S. Cl. ..... 339/276 T

[51] Int. Cl.[2] ..... H01R 11/08

[58] Field of Search ..... 339/276; 174/84 C

[56] References Cited

UNITED STATES PATENTS

| | | | |
|---|---|---|---|
| 2,716,744 | 8/1955 | Swanson | 339/276 R |
| 2,816,276 | 12/1957 | Fuller et al. | 339/276 T |
| 2,906,987 | 9/1959 | Fox | 339/276 T |
| 3,196,382 | 7/1965 | Morello | 339/276 R |
| 3,221,290 | 11/1965 | Stark et al. | 339/276 T |
| 3,314,044 | 4/1967 | Powell | 339/276 R |

*Primary Examiner*—Joseph H. McGlynn
*Attorney, Agent, or Firm*—M. Michael Carpenter

[57] ABSTRACT

An electrical connector system is shown in which a sheet metal contact with an open barrel wire receiving portion is attached to a wire conductor by spirally crimping the open barrel closed upon the wire. The spiral crimp is formed from multiple opposed indents, each arranged at an angle to the longitudinal axis of the contact and each decreasing in depth to smoothly merge with the diameter of the open barrel portion to prevent stress build-up. Shoulders are provided on each side of the crimped surface of the open barrel to strengthen the contact and prevent distortion.

6 Claims, 6 Drawing Figures

SPIRAL CRIMP FOR RETAINING A WIRE CONDUCTOR IN A METAL CONTACT

This application is a continuation-in-part of application Ser. No. 493,862, filed Aug. 2, 1974 and now abandoned.

BACKGROUND OF THE INVENTION

The present invention relates to an electrical connector system having an arrangement for connecting a wire conductor to a metal contact and, more particularly, to a metal contact having an open barrel portion which receives a wire conductor therein and is closed on the wire by multiple opposed indents arranged at an angle to the longitudinal axis of the contact.

It is well known in the prior art to provide an electrical contact having an open barrel portion with indents which close the barrel and thus secure the contact to the wire conductor inserted therein. Various types of indents have been utilized, including full circumferential indents, a single indent, opposed indents, multiple indents and multiple, angled indents. An example of a full circumferential indent is shown in U.S. Pat. No. 2,929,864 by Aune et al, while an example of a single indent is shown in U.S. Pat. No. 2,429,585 by Rogoff. An example of multiple, angled indents is shown in U.S. Pat. No. 2,816,276 by Fuller et al.

A full circumferential indent is difficult to accomplish and results in a general oval cross section rather than a circle. Through this arrangement there is little keying or centering of the wire conductor in the contact. A single indent requires a very deep indentation to secure the contact to the wire conductor which causes gross distortion of the contact cross section. Opposed indents permit the use of a medium-depth indentation but again cause distortion to the contact. Multiple opposed indents have been proposed as the most desirable way to provide medium-depth and minimum distortion of the contact while attaching that contact to a wire conductor. Angled, multiple opposed indents have the same advantage as multiple indents but each still tend to distort the contact, especially when the indents are formed with vertical walls surrounding the indent on all sides.

In the prior art, multiple opposed indents are generally parallel to the axis of the contact and work satisfactorily on a contact manufactured by a screw machine from a solid piece of metal. However, these mutiple opposed indents do not work satisfactorily with a contact manufactured by a continuous die stamping machine from a rolled or stamped piece of sheet metal. The reason for this is that a rolled or stamped sheet metal contact must, due to its construction, be provided with a seam which runs through the outer surface of the contact parallel to its longitudinal axis. When the open barrel portion of a sheet metal contact is closed by a multiple opposed crimping arrangement, there is a high probability that one of the multiple opposed indents will hit or come close enough to the seam so as to open or separate the seam and deform the contact beyond an allowable tolerance. The angled, multiple opposed indents of the prior art were developed to solve this problem. However, such indents continue to distort a sheet metal contact.

SUMMARY OF THE INVENTION

The present invention eliminates the disadvantage of crimping a sheet metal contact with multiple opposed indents by arranging the opposed indentations at an angle to the longitudinal contact axis to form a spiral crimp. The spiral crimp tends to create a turning, closing action as the open barrel wire receiving portion of the contact is closed upon the wire conductor. Because of the angled arrangement, each opposing indentation cannot hit or align itself with the contact seam so as to force the seam open during crimping. Instead, the spiral crimp retains the open barrel configuration as the opposed indents are formed therein. Each indentation is formed with a straight bottom surface which is long enough to allow the indent surface to smoothly merge with the outer diameter of the open barrel wire receiving portion of the contact without creating a stress forming shoulder therein.

The present invention provides an angled indentation about the periphery of an open barrel wire receiving portion of a contact that engages more strands of a multi-strand wire conductor or more efficiently grips a solid wire conductor retained within the crimped barrel. This arrangement increases the size variations of a wire conductor which may be received by one given open barrel configuration.

The spiraling action of the angled crimp indentations also tends to self-center the contact on the wire conductor as the open barrel portion of the contact is crimped thereon. The angled arrangement of the indents creates a twisting interaction between the contact and the conductor wire similar to the twisting of a strand of rope which increases the pull-out force required to remove the wire conductor from the contact. Further, distortion of the contact is prevented during crimping by shoulders on each side of the outer diameter of the open barrel portion which receives the angled indents.

Accordingly, the present invention provides an improved spiral crimp arrangement wherein multiple opposed indents are formed at an angle to the longitudinal axis of a contact for attaching that contact to a wire conductor. The objects accomplished by this invention include the provision of a contact crimp arrangement which will not open a seam within a sheet metal contact, the provision of a contact crimp arrangement which will increase the pull-out force between the contact and the wire conductor, a contact crimp arrangement which will increase the number of wire conductor sizes that may be received by the contact, a contact crimp arrangement which will center the contact upon the wire conductor, and an arrangement which will prevent the deformation of the contact during crimping. These and other objects are accomplished by the provision of a spiral crimp configuration.

BRIEF DESCRIPTION OF THE DRAWINGS

A better understanding of the present invention and of the objects and appendant advantages thereof will be obtained by reference to the following description when considered in connection with the accompanying drawings, wherein.

DESCRIPTION OF THE PREFERRED EMBODIMENT

Figure 1:
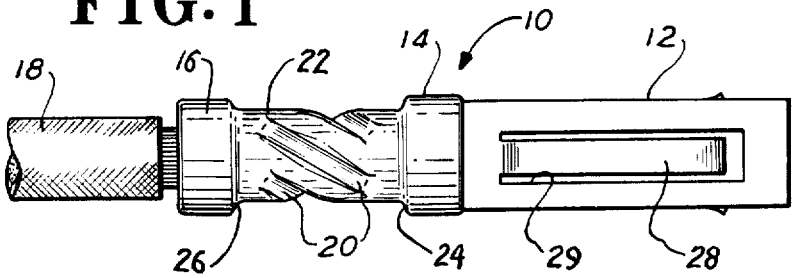
FIG. 1 is a side elevation view showing a female contact with a wire conductor attached thereto by the spiral crimp arrangement of the present invention.

Referring now to the drawings, FIG. 1 shows an electrical connector system including a female contact 10 that may be formed from a piece of solid metal wire on a screw machine or may be rolled or stamped into a tubular shape from a piece of sheet metal on a continuous die stamping machine. The contact 10 includes a female contact portion 12, central portion 14 and open barrel portion 16. The open barrel portion 16 receives a wire conductor 18 along the longitudinal axis thereof and is crimped upon the wire 18 by the formation of four angled, multiple opposed indents 20 located in a crimp receiving area 22 formed in the circumferential periphery of the open barrel portion 16.

The outer diameter of the open barrel crimp receiving area 22 is smaller than the outer diameter of the central portion 14, thus forming a shoulder 24 therebetween. The outer diameter of the open barrel crimp receiving area 22 is again increased at a second shoulder 26 on the opposing end thereof so that the open barrel portion 16 terminates at the end of the contact with an outer diameter equal to the outer diameter of the central portion 14. Shoulders 24 and 26 serve to strengthen the contact 10 and the open barrel portion 16 as the crimp indents 20 are placed in the crimp receiving area 22. The strengthening shoulders 24 and 26 thus prevent distortion of the contact during crimping.

The female contact portion 12 is formed as a tube having a wiping tang 28 formed in its side wall by a U-shaped cut 29. The tang 28 is bent into the tube formed by the female contact portion 12 for wiping a male contact 30, FIG. 2, as it is inserted therein.

Figure 2:
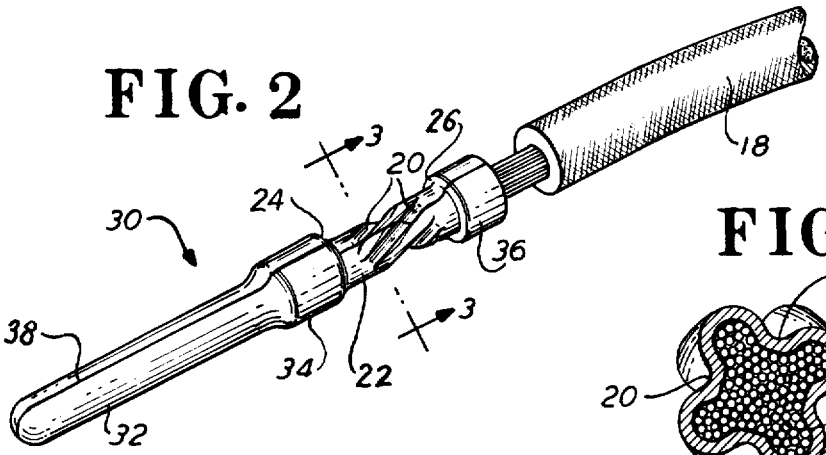
FIG. 2 is a perspective view showing a male contact with a wire conductor attached thereto by the spiral crimp arrangement.

In FIG. 2 it will be seen that a male contact 30 is formed in a manner similar to the female contact 10 with a male contact portion 32, a central portion 34 and an open barrel portion 36. The central portion 34 and open barrel portion 36 are identical to portions 14 and 16 of the female contact 10 shown in FIG. 1 with the open barrel portion 36 including strengthening shoulders 24 and 26 on opposite sides of indents 20 in the crimp receiving area 22. The male contact 30, which is stamped into a rolled configuration from a piece of sheet metal, is formed with a seam 38 arranged parallel to the longitudinal axis and within the peripheral wall thereof. The wire conductor 18 is inserted into the open barrel portion 36 and crimped by a crimping tool 40, such as that partially shown in FIG. 4, to close the outer periphery of the open barrel portion 36 upon the conductive portion of the wire.

It will be seen in FIGS. 1 and 2 that the indents 20 formed by the tool 40 upon the contacts 10 and 30 are formed at an acute angle to the longitudinal axis of the contacts. The angle of the indents 20 creates a spiraling effect as the open barrel 36 is crimped upon the conductive portion of wire 18 for closing the open barrel in a rotating-like manner upon the wire. This closure tends to reinforce the mechanical fastening between the wire 18 and the open barrel portion 36 of the contact much in the same way that strands of rope are given increased strength through their woven, twisted configuration. Further, the spiral closure of the crimp 20 assists in centering the wire 18 within the open barrel 36 as the barrel is closed thereon.

Figure 3:
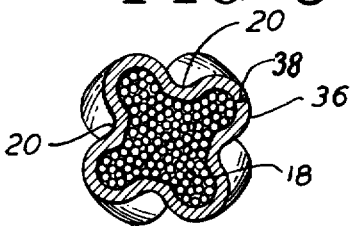
FIG. 3 is a cross-sectional view taken along lines 3—3 of FIG. 2 showing a cross section of the spiral crimp.

This concept will become clearer by reference to FIG. 3 which shows a cross section taken along lines 3—3 of FIG. 2. If one were to move the cross section 3—3 of FIG. 2 along the longitudinal axis of the contact 30 of FIG. 2 toward the wire conductor 18 and plot successive cross sections, the star-shaped cross section of the conductive portion of wire 18 would be seen to rotate in a counterclockwise direction. Besides providing for an increased pull-out force between the wire 18 and the contact 30 and for centering the wire within the contact, the angled configuration of the indents 20 ensures that the seam 38 of contact 30 is never hit and opened by the indentor.

Figure 4:
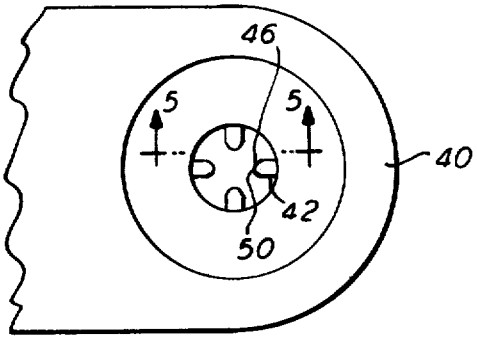
FIG. 4 is a front view of a crimp tool which employs four indentor teeth for forming multiple opposed indents.
Figure 5:
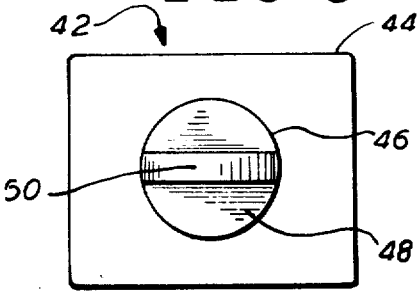
FIG. 5 is a cross-sectional view taken along lines 5—5 of FIG. 4 showing an end view of an indentor tooth used in the tool of FIG. 4 to form a crimp.

Referring to FIGS. 4 and 5, the indentation within an open barrel contact portion 36 may be formed by a hand tool such as that shown at 40 in FIG. 4 wherein the head portion shown contains a chuck-like jaw of multiple teeth which, when the hand tool is squeezed, close toward the center. The jaw is formed by four indentor teeth 42 which close about the open barrel portions 16 or 36 of contacts 10 or 30. If an indentor tooth shown in detail in FIG. 5 were used, the indents 20 would be formed parallel to the longitudinal axis of the contact 10. The indentor 42, shown in enlarged detail in FIG. 5, consists of a square mounting base 44 having a circular tool column 46 extending therefrom. The tool column 46 is chamfered at 48 to form a flat tip 50 which shapes the indents 20.

Figure 6:
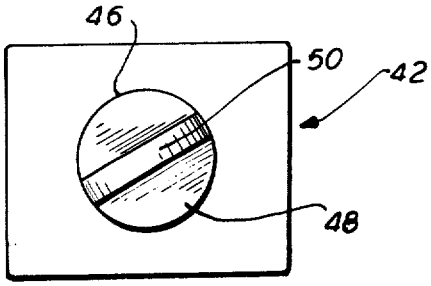
FIG. 6 is an end view similar to FIG. 5 showing an indentor tooth which may be used to form the spiral crimp of the present invention.

The spiral crimp of the present invention is formed by four similar indentor tools 42, one of which is shown in FIG. 6, wherein each flat tip 50 is offset from the axis by 30°, for example. By reference to FIG. 1, it will be seen that the indent 20 formed by the indentor 42 of FIG. 6 has a flat bottom which decreases in depth at the ends of the indentation and smoothly merges with the outer diameter of the crimp receiving area 22. The merging indent thus formed is in effect without ends and takes on a configuration similar to the merging of a chord with a circle from which a segment has been cut by the chord. This configuration allows the gross distortions normally created within the open barrel 16 to be dissipated toward the ends of the indents 20, which is precisely the area where such gross distortions are normally greatest. In the prior art design, a shoulder is generally formed at the ends of the indent which creates an undesirable stress build-up. The length of the angled indents 20 is designed to be long enough to ensure that the straight bottom thereof passes beyond the curved surface formed by the outer diameter of the crimp receiving area 22. The length of the flat tip 50 of each indent forming tool 42 is short enough, however, to ensure that the strengthening shoulders 24 and 26 are not deformed during crimping. Lastly, the length of each indent 20 is long enough to allow each angled indent to deform an arc of the outer diameter of the crimp receiving area 22 such that the full 360° periphery of the crimp receiving area 22 is deformed as it is crimped upon the wire conductor 18.

By fully deforming the periphery of the crimp receiving area 22 of the open barrel portion 16 or 36 about the wire conductor 18, the force required to pull the wire from the contact is greatly increased. The arrangement also allows for a greater variation of wire sizes to be inserted into the open barrel portion 16 or 36 without requiring reconfiguration of the open barrel.

Figure 7:
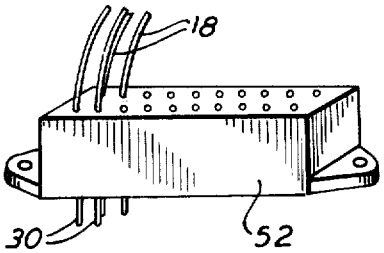
FIG. 7 is a perspective view showing a plurality of male contacts connected to wire conductors mounted within an insulated housing.

In the preferred embodiment, the female contacts 10 and male contacts 30 are normally inserted into an insulated housing, such as that shown generally at 52 in FIG. 7, which receives male contacts 30. As is known in the art, the configuration of the housing 50 may be designed to allow for the insertion and removal of the male contacts 30 without disconnecting the wire conductor 18 from its crimped connection in the open barrel portion 36 of the contact.

The spiral crimp configuration of the invention thus described solves several problems known to exist in prior art crimping arrangements. Beyond the increased holding force, centering, increased tolerance range, improved crimp configuration for a rolled contact, and elimination of contact distortion, those skilled in the art may foresee other advantages not described herein but contemplated by this invention.

The embodiments of the invention in which an exclusive property or privilege is claimed are defined as follows:

1. An electrical connector system comprising:

a pair of axially mating contacts, one having a male and one a female mating portion and each having a central portion and an open barrel portion joined to said male and female mating portions by said central portion;

said open barrel portion having a reduced outer diameter compared to said central portion for forming an indent receiving surface with a first shoulder formed between said central portion and said open barrel portion and an opposing second shoulder formed on the opposite end of said indent receiving surface;

wire conductor means received by said open barrel portion;

multiple opposed indents in said indent receiving surface of said open barrel portion for closing said indent receiving surface of said open barrel portion upon said wire conductor means;

said multiple opposed indents arranged at an angle to said contact axis, each indent long enough to deform an arc of said outer diameter of said indent receiving surface such that the full periphery thereof is deformed by said multiple indents; and said multiple opposed indents each having a bottom surface that decreases in depth below said outer diameter of said indent receiving surface to tangentially and smoothly merge with said surface for forming a spiraling, stress-free crimp characterized by the absence of end shoulders.

2. An electrical connector as claimed in claim 1 wherein said connector comprises a plurality of contact pairs mounted within a connector housing pair.

3. An electrical connector as claimed in claim 1 wherein said pair of contacts are formed from rolled sheet metal with four multiple opposed indents in said indent receiving surface of said open barrel portion, and each indent deforms an arc of said outer diameter that is greater than 90°.

4. An electrical connector as claimed in claim 3 wherein said angle of said multiple opposed indents to said contact axis is 30°.

5. An electrical connector system for attaching wire conductors via a pair of axially mating conductive metal contacts, comprising:

said contact pair having a male and female mating portion, each joined to an open barrel portion by a central portion;

said open barrel portion having a reduced outer diameter compared to said central portion for forming an indent receiving surface having a first shoulder formed between said central portion and said open barrel portion and an opposing second shoulder formed on the opposite end of said indent receiving surface;

four opposed indents in said indent receiving surface of said open barrel portion for closing said open barrel portion upon said wire conductor received therein;

each indent arranged at an angle to said contact axis, each indent long enough to deform an arc of greater than 90° of the outer diameter of said indent receiving surface; and each indent having a flat bottom surface that decreases in depth below and tangentially merges with said outer diameter of said indent receiving surface for forming a spiraling, stressfree crimp having no end shoulders at said tangential merger with said indent receiving surface after said surface of said open barrel portion is crimped upon said wire conductors.

6. An electrical connector system for attaching wire conductors via a generally tubular pair of mating conductive contacts, comprising:

said contact pair having a male and female mating portion each joined to a tubular open barrel portion which receives said wire conductor;

multiple opposed indents in said open barrel portion for closing said open barrel portion upon said wire conductor;

said multiple opposed indents arranged at an angle to said tubular open barrel portion having a flat bottom long enough that said bottom of said indent decreases in depth with relation to the open barrel of said tubular contact to smoothly merge therewith for forming indents having no end shoulders at such merger with said open barrel portion and having sides long enough to deform the full periphery of said open barrel portion.

* * * * *